US005596181A

United States Patent [19]

Bach et al.

[11] Patent Number: 5,596,181

[45] Date of Patent: Jan. 21, 1997

[54] ELECTRIC SWITCH

[75] Inventors: Erik Bach, Billund; Morten Rydder, Vejle, both of Denmark

[73] Assignee: INTERLEGO AG, Baar, Switzerland

[21] Appl. No.: 433,418

[22] PCT Filed: Nov. 23, 1993

[86] PCT No.: PCT/DK93/00381

§ 371 Date: May 23, 1995

§ 102(e) Date: May 23, 1995

[87] PCT Pub. No.: WO94/13001

PCT Pub. Date: Jun. 9, 1994

[30] Foreign Application Priority Data

Nov. 24, 1992 [DK] Denmark ..... 1408/92

[51] Int. Cl.[6] ..... H01H 21/00; H01H 19/00; A63H 33/00

[52] U.S. Cl. ..... 200/8 R; 200/11 R; 200/17 R; 200/43.08; 200/43.04

[58] Field of Search ..... 200/1 R, 1 A, 200/1 TK, 1 B, 1 V, 5 R, 6 R, 6 B, 6 BB, 6 BA, 6 C, 331, 335, 11 R, 11 G, 14, 17 R, 18, 8 R, 8 A, 24–26, 43.04–43.08, 336, 339

[56] References Cited

U.S. PATENT DOCUMENTS

| | | | |
|---|---|---|---|
| 3,480,752 | 11/1969 | Cherry et al. | 200/335 |
| 3,617,676 | 11/1971 | Dennison | 200/331 |
| 4,133,990 | 1/1979 | Wanner et al. | 200/6 B |
| 4,272,658 | 6/1981 | Crosby | 200/6 B |
| 4,313,041 | 1/1982 | Ohashi et al. | 200/6 R |
| 4,855,541 | 8/1989 | Yamashita et al. | 200/6 R |

FOREIGN PATENT DOCUMENTS

| | | | |
|---|---|---|---|
| 2389988 | 12/1978 | France | H01H 19/08 |
| 2225066 | 6/1974 | Germany | H01H 19/00 |

*Primary Examiner*—J. R. Scott

*Attorney, Agent, or Firm*—Kane, Dalsimer, Sullivan, Kurucz, Levy, Eisele and Richard, LLP

[57] ABSTRACT

An electric switch for toys comprises a stationary member and a member rotatable with respect to the stationary member. The stationary member includes a plurality of electrical connections in the physical form of fixed, variable configured contacts with integral terminals. The contacts are bridged by conductive pattern(s) forming part of the rotatable member. Circuits are broken or made which are dependent upon the position of the rotatable member. The rotatable member includes a coupling, preferably a cruciform hole for detachably mounting a protruding lever or protruding shaft. The rotatable member can be rotated between a plurality of premarked positions when the lever or shaft is mounted within the coupling hole. The switch may be used as a building block component.

9 Claims, 3 Drawing Sheets

ELECTRIC SWITCH

BACKGROUND OF THE INVENTION

The invention concerns an electric switch for toys and comprising a stationary member and a member rotatable with respect to the stationary member, said stationary member having a plurality of electric connections which are broken and made by rotation of the rotatable member.

In toys and particularly in construction building sets various electric units are energized to provide various functions. Thus, there may be a need for making electric connections sequentially, e.g. for causing light sources to light periodically. In other cases it may be desirable that the user can switch between several different functions, e.g. to control points to which is to be applied reversing of the travelling direction of a toy train, or by activation of the dump body of a toy truck.

U.S. Pat. No. 3,480,752 discloses a contact or switch having a removable, protruding lever. A coupling is established between this lever and the rotatable shaft of the contact, permitting the lever to be assembled and removed without the switch being loaded critically. The switch can be moved between two extreme positions, but it is not explained how the electric connections of the contact are actually made.

U.S. Pat. No. 4,313,041 discloses a switch for mounting on a printed circuit board. Here it is often interesting to break and make several circuits at the same time. Such printed circuit boards are often encased in a housing or a box and are therefore not very accessible. With the technique described in the patent specification several switches can be coupled together axially by means of a through shaft. When a switch is operated, the shaft coupling brings along the other switches incorporated in the coupling. The contact is established by means of a rocking body in the form of a rocker spring by means of which a contact point can be connected with two alternative contact points.

SUMMARY OF THE INVENTION

The object of the invention is to provide an electric switch for use in connection with toys, which can be employed for performing a plurality of switching functions, e.g. as an on/off element, a pole reverser or a sequence device, depending upon the coupling.

This object is achieved according to the invention with an electric switch, when a protruding lever is mounted on the rotatable member of the switch, the electric connections of the stationary member can be actuated by moving the lever from one position to another, causing the rotatable member to be rotated. When the protruding lever is removed from the rotatable member, this can be driven by an external drive, so that the contacts are actuated periodically by the rotation of the rotatable member. The electric connections are hereby broken and made sequentially.

Furthermore, the rotatable member is substantially cylindrical and has an axial passage. The coupling means preferably consist of radial bushings to receive a protruding lever. Both the axial through passage and the radial bushings are expediently formed with a cruciform hole to receive a cruciform lever or a cruciform shaft, which is retained by friction.

The stationary member of the switch is preferably constructed to include a slot, since the lever can hereby be moved within the recess of the slot, so that the rotating member can be rotated through an angle corresponding to the extent of the slot in the circumferential direction of the rotating member.

Furthermore the terminal parts on the electric connections of the stationary member may advantageously be constructed as leaf springs which overlap each other over part of their longitudinal direction. When one of the leaf springs of a terminal part deflects, the two terminal parts will be contacted with each other, and this can take place in that radially protruding bosses are provided on the rotating member which, upon rotation of the rotatable member, bring the leaf springs into contact with each other when the bosses pass them. The length of the bosses in the circumference of the rotatable member may be varied from just a few degrees to a considerable portion of the circumference of the rotatable member, thereby also changing the part of the period of the rotatable member in which the connection is made.

Alternatively, the terminal parts may be constructed so that the conducting material on one of the paths may be used for making several electric connections. The collector shoes are expediently provided on a leaf spring, so that the collector shoes engage a rotating member and press against the path with a force well-defined in advance.

Furthermore, the pattern of the made contacts runs through a sequence by rotation of the rotatable member, and this sequence may be divided into a plurality of subsequences which are symmetrical, i.e. the make pattern is the same in clockwise as well as counterclockwise rotation, it being possible to arrange the coupling means on the rotatable member such that the protruding lever can be mounted in a number of positions corresponding to the number of subsequences multiplied by two. Then, when the lever is in its one extreme position in the slot, it will hereby be possible to remove the lever and to mount it in the coupling means at the other end of the slot. Exactly the same sequence portion will hereby be run through when the arm is moved in the slot, as when the arm was in the first position; but the run-through will be directed opposite to the run-through of the first position. When the switch is used in an on/off function, it will thus be possible to reverse the on/off positions merely be moving the lever.

The switch is unique in that precisely two identical subsequences are run through by rotation of the rotatable member, it being possible to mount the protruding lever in four positions. This switch is particularly useful as a pole reverser.

BRIEF DESCRIPTION OF THE DRAWINGS

The invention will be explained more fully below in connection with preferred embodiments and with reference to the drawing, in which.

DETAILED DESCRIPTION OF THE PREFERRED EMBODIMENT

Figure 1:
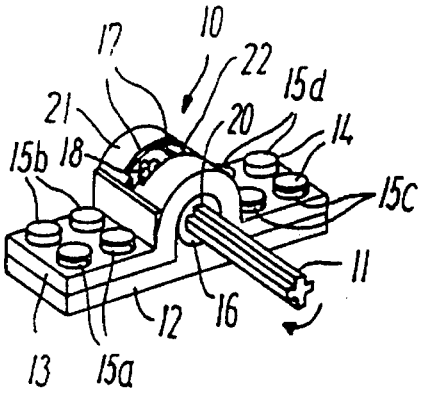
FIG. 1 is a perspective view of a preferred embodiment of an electric switch according to the invention, where the rotating member of the switch is driven by an axially mounted shaft.

FIG. 1 shows a switch according to the invention, which is generally designated by the reference numeral 10. The switch 10 has a rotating member 16 which is mounted between the lower part 12 and the upper part 13 of a stationary member. The upper part 13 of the stationary member is formed with coupling studs 14 on its upper side for connection with the other building elements of a construction building set, said coupling studs 14 being formed with conductive contact faces 15 along part of their side faces. The rotating member 16 has an axial passage 20, which preferably extends therethrough, and in which a shaft member 11 is to be received and retained by friction. The through passage 20 is here formed with a cruciform cross-section, so that it has a cross-section which corresponds to one of the existing elements of the construction building set.

In a preferred embodiment the coupling studs 14 on one side of the rotating member 16 serve as input terminals. The coupling studs on the other side of the rotating member 16 then serve as output terminals. The design of the coupling studs 14 and their electric and mechanical connection with other components of the toy building set are described in U.S. Pat. No. 4,552,541. The preferred embodiment includes a first and a second input terminal 15*a* and 15*b* and a first and a second output terminal 15*c* and 15*d*.

As will be explained more fully below, the stationary member includes a plurality of electric connections which are made and broken when the shaft 11 rotates. Thus, the electric connections between the terminal parts 15*a*–15 *b* and 15*c*–15*d* of the input and output ends will be broken and made periodically. An arched portion 21 in the upper part 13 is shown with a slot 21 through which the rotating member 16 with a cruciform hole 18 is visible. Notches 17, whose function will be explained in connection with FIG. 2, are provided along the rim of the slot 22.

Figure 2:
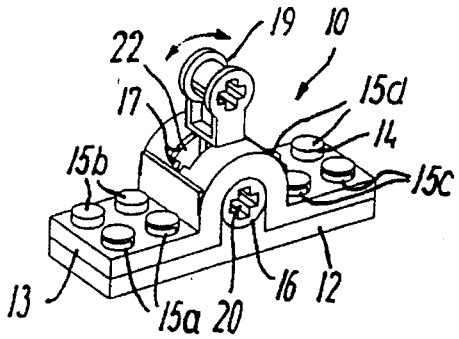
FIG. 2 shows the switch of FIG. 1, where the axially mounted shaft is replaced by a protruding lever.

FIG. 2 shows the switch of FIG. 1 in which the cruciform shaft 11 is replaced by a lever 19, which is received in the slot 22 on the arched portion 21, said lever 19 being introduced into the cruciform hole 18 on the rotating member 16. Reception and retention take place by friction, and when the lever 19 is moved in the directions shown by the arrow, it is possible to rotate the rotating member 16, so that, when replacing the shaft 11 with a radially protruding lever 19, the switch of FIG. 1, which periodically runs through a make pattern, can be converted to a switch which makes it possible to select between a plurality of the make states.

The notches 17 along the slot 22 serve as marked positions of the lever 19, which has a width such that the stationary member is subjected to small internal stresses when the lever 19 is not aligned with the notches 17, but is at rest when the lever 19 is aligned with a notch 17.

The location of a notch 17 corresponds to a switch position and thus to an intended connection between the input and output terminals of the switch.

Figure 3:
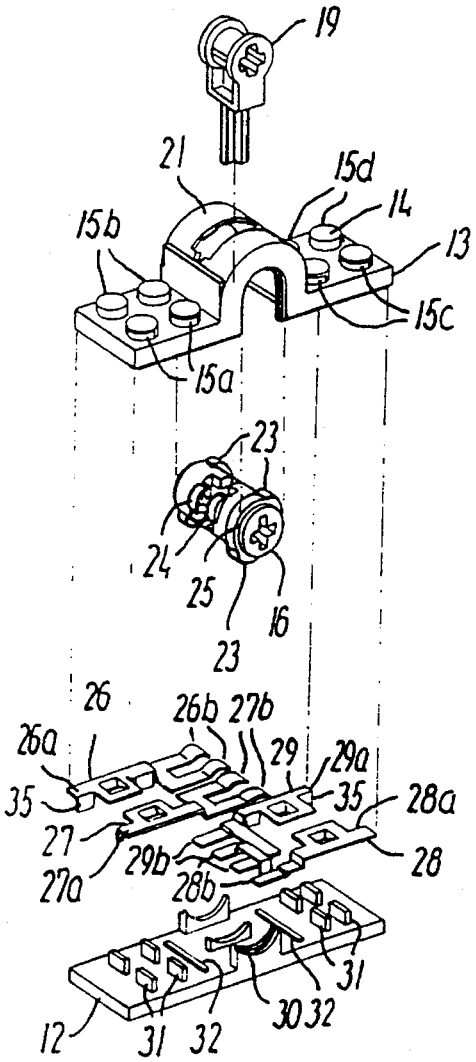
FIG. 3 is an exploded view of the switch of FIG. 2.

FIG. 3 is an exploded view of the switch of FIG. 2, and it will be seen that the protruding lever 19 has a cruciform shaft part as well as a head in which a cruciform shaft can be received transversely. The upper part 13, which is substantially shaped as an Ω, will be explained more fully in connection with FIG. 4.

The rotatable member 16 is substantially cylindrical and has two ring-shaped faces 25 at its respective ends, said faces 25 resting on bearing faces 30 on the lower portion of the stationary part. In the preferred embodiment the rotatable member has four sets of bosses 23, 24, each set consisting of two bosses located diametrically in pairs. The bosses 23, 24 are rounded in the circumferential direction of the rotatable member. The bosses 23 and 24 are arranged 90° offset with respect to each other, and their extent in the circumferential direction corresponds to an angle of about 45°.

The actual contact between the input terminals 15*a*–15*b* and the output terminals 15*c*–15*d* of the switch is established by means of four conductive and resilient metal elements 26–29. Each of the elements 26–29 has a coupling part 26*a*–29*a* by means of which contact is established with the terminals 15*a*–15*d* on the coupling studs 14 when the switch has been assembled. It will be seen that the elements 26–29 branch in a number of branches corresponding to the number of input/output terminals—here two. Two of the branches on the elements 28 and 29 intersect each other, so that the branches 26*b*–29*b* are caused to overlap each other in a manner such that the branches 26*b* on the element 26 overlap branches 28*b* and 29*b* on the elements 28 and 29, respectively. Correspondingly, the branches 27*b* on the element 27 overlap a respective branch 28*b* and 29*b* on the elements 28 and 29. Since the mutual overlap of the branches 26*b*–29*b* creates an air gap between the overlapping portions, contact between the input terminals 15*a*–15*b* and the output terminals 15*c*–15*d* can be established by pressing selected branches 26*b*–27*b* against the branches 28*b*–29*b*.

The lower part 12 of the stationary member has two upright wall portions 30 which serve as bearings for the rotating member 16. In addition, the lower part 12 interiorly has eight projections 31, by means of which the conducting elements 26–29 are fixed with respect to the upper part 13 of the stationary member. In addition, the lower part 12 has two lower projections 32 which cooperate with corresponding projections on the underside of the upper part 13 to retain the branches 26*b*–29*b* in a predetermined well-defined mutually spaced relation.

Figure 4:
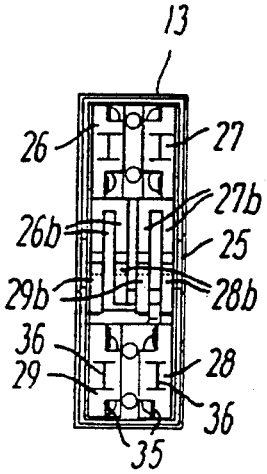
FIG. 4 is a schematic view of the electric connections on the stationary member of the switch of FIGS. 1–3.

FIG. 4 shows the upper part 13 of the stationary member, and it will be seen that the conducting metal elements 26–28 are arranged such that the branches 26*b*–29*b* overlap each other. Also the ring-shaped faces 25 on the rotatable member 16 are visible. It will be seen that flaps 35 protrude from the elements 26–29 substantially at right angles from said elements. The function of the flaps 35 is to retain the conducting elements 26–29 in their position, and the flaps thus serve the same purpose as the projections 31. In addition, each of the elements 26–29 is formed with a slot 36 in which a protruding flap in contact with the terminals 15*a*–15*d* ensures electric connection with the conducting elements 26–29. The flaps in the slot 36 are retained by friction.

Figure 5:
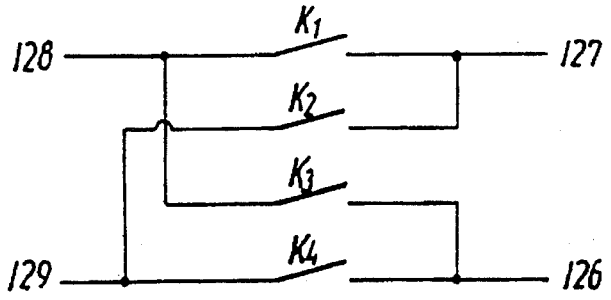
FIG. 5 is an electrical diagram of the switch of FIGS. 1–4.

FIG. 5 shows the circuit diagram of the switch of FIGS. 1–4. Four nodes 126–129 are connected to respective electric terminals 15*a*–15*d*, and it will be seen that the diagram of the electric circuit contains four contacts K1–K4. With the rotating member 16 constructed as stated in connection with FIG. 3, the contacts K1–K4 are closed in pairs, which means that K1 and K4 are closed at the same time, and that K2 and K3 are closed at the same time. When K1 and K4 have been closed, the node 128 is connected to the node 127, and the node 129 is connected to the node 126. When K2 and K3 are closed, the node 128 is connected to the node 126, while the node 129 is connected to the node 127. In this embodiment it is important that the four contacts K1–K4 are not closed at the same time, since, otherwise, the inputs will be shortcircuited.

Figure 11:
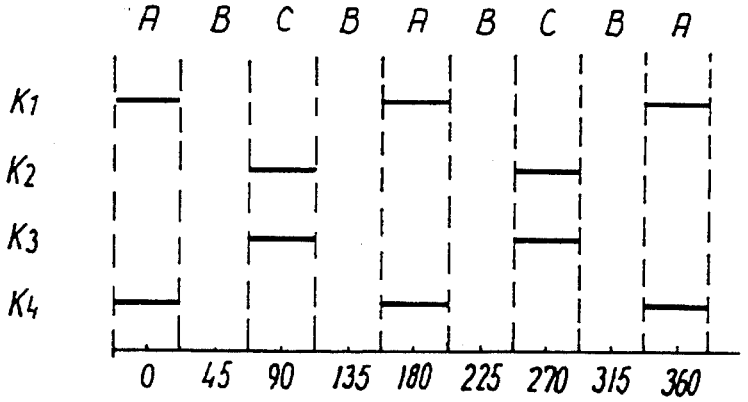
FIG. 11 shows the make pattern of the electric switch of the invention shown in FIGS. 1–3.

Since it is the bosses 23, 24 of the rotating member 16 that close the contacts K1–K4, they can form the close pattern or make diagram shown in FIG. 11 with the extent in the circumferential direction of the rotating member 16 of about 45° mentioned in connection with FIG. 3.

It is shown along the horizontal axis in the diagram 11 which contacts are made when the rotating member 16 is rotated a full revolution (shown in degrees). The contacts K1–K4 are shown upwardly, and a horizontal line indicates that the contact in question has been made. It will thus be appreciated that the chosen bosses enable the establishment of a make pattern having a number of states, which can e.g. correspond to a rotation of 45° each. The state A indicates that the node 127 is connected to the node 128, and that the node 126 is connected to the node 129. The state B indicates that there is no contact between the nodes 126, 127 and the nodes 128, 129. The state C indicates that the node 126 is connected to the node 128, and that the node 127 is connected to the node 129. It will thus be appreciated that rotation of the rotating member 16 results in run-through of a make sequence ABCBABCBA when the rotating member 16 is rotated a full revolution. In the present case this sequence is formed by two subsequences ABCBA, which is utilized with the embodiment shown in FIG. 2, it being here possible e.g. to place the bushings 18 in the rotating member 16 (FIG. 3) in positions which correspond to the angular positions 0°, 90°, 180°, 270° (FIG. 11).

It will thus be appreciated that with a slot 22 permitting a 90° movement of the lever 19, state A may be established in one extreme position and state C in the other extreme position, while state B (where the output terminals are isolated from the input terminals) is obtained in the central position. When the lever 19 is in its one extreme position, the lever 19 can be removed and mounted in another bushing hole in the other extreme position, so that the states A and C change places.

Figure 6:
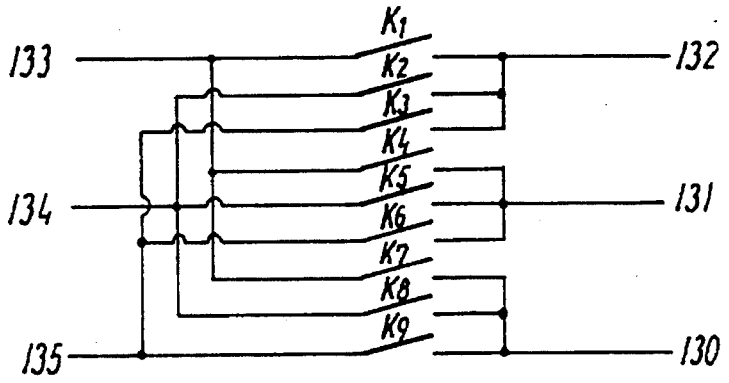
FIG. 6 is an electrical diagram of an alternative embodiment of the switch of the invention.

FIG. 6 shows an alternative embodiment of an electric circuit diagram that can be achieved with a switch of the type shown in FIGS. 1–4. This embodiment includes three different input terminals 130–132 that can be connected to the output terminals 133–135. This is done by making the contacts in the same manner as explained in connection with FIG. 5, the contacts K1, K4 and K7 being made at the same time, which also applies to the contacts K2, K5, and K8 and K3, K6, and K9, respectively. The node 133 is hereby successively brought into contact with the nodes 132, 131, 130, while the node 134 is similarly successively brought into contact with the nodes 131, 130 and 132, and the node 135 is successively brought into contact with the nodes 130, 132 and 131. If these states are designated A, B and C, respectively, the make pattern upon rotation of the rotating member 16 will be as follows ADBDCDADBD . . . , when D indicates the state where there is no contact between any of the terminals 130–132 and the terminals 133–135. It will be appreciated that the subsequences do not have the same symmetry as the one obtained in connection with FIG. 11; but this is merely a question of adapting the position of the bosses on the rotating member such that the desired symmetry can be obtained.

Figure 7:
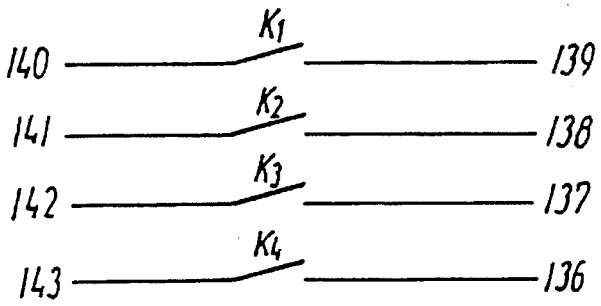
FIG. 7 is an electrical diagram of a further embodiment of an electric switch according to the invention.

FIG. 7 shows a further electrical diagram of a switch according to the invention, in which four inputs 136–139 can be connected to respective outputs 140–143 when the contacts K1–K4 are made. The switch is extremely simple, since the electric connection between an input terminal and an output terminal is broken and made as a consequence of the rotation of a rotatable member. When the nodes 140–143 are connected to the same source of voltage, the nodes 136–139 can represent a digital signal consisting of 4 bits. The actual value of the digital signal represented on the nodes 136–139 is dependent on the position of the contacts K1–K4. The bosses of the rotating member can be constructed such that the digital signal is counted up from zero to fifteen, and then down to zero again.

Figure 9:
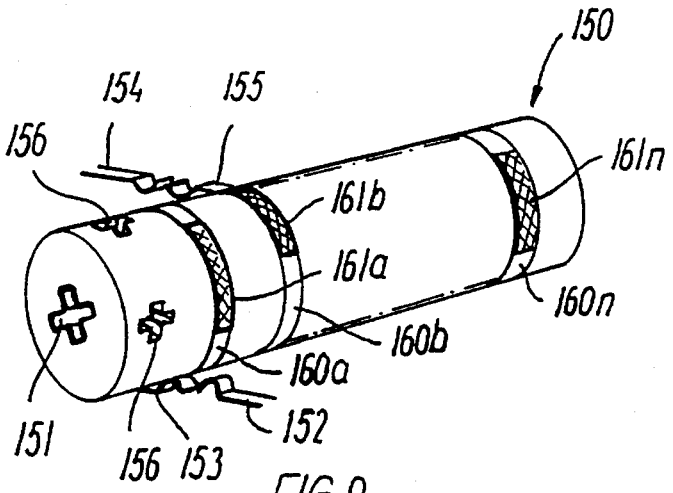
FIG. 9 shows a further embodiment of a rotating member on a switch according to the invention.

FIG. 9 shows an alternative embodiment of a rotatable member for a switch according to the invention. The rotatable member is generally designated by the reference numeral 150, and it will be seen that it is substantially cylindrical and provided with an axial passage 151 to receive a shaft part and with a plurality of radially extending passages 156 in which radially extending levers can be mounted. It is noted that the passages 156 are provided at one end of the rotatable member. Both the shafts (not shown) and the extending levers can of course be received in manners known per se by friction or by snaplocking or the like. It will be seen that a plurality of annular paths **160*a*–160N are provided, each path 160*a*–160N being formed with one or more path segments 161*a*–161N which are coated with conductive material. A plurality of collector shoes 152–155 of an electrically conductive material are pressed against and are in contact with each of the paths 160*a*–160N during the rotation of the rotatable member 150. There will thus be electric contact between two collector shoes when both of these are in contact with the same conductive segment 161*a*–161N. The number of collector shoes 152–155 in contact with the same path 160*a*–160**N is at least two.

Figure 8:
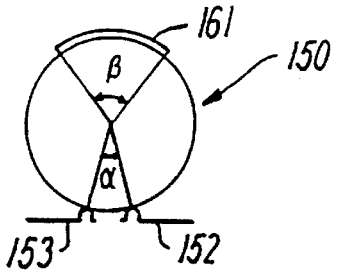
FIG. 8 is a schematic view of an alternative embodiment of the rotating member on a switch according to the invention.

FIG. 8 schematically shows a rotatable member 150 having two collector shoes 152, 153. These are arranged at a certain mutual distance, which, in terms of angle, corresponds to an angular distance $\alpha$. Conductive material is provided along an angular segment 161 corresponding to an angle $\beta$ of the entire circumference. For the conductive segment 161 to be able to make contact with the collector shoes 152 and 153 at all, the angle $\beta$ must be greater than the angle $\alpha$. When the rotatable member rotates, the collector shoes 152 and 153 are interconnected for a fraction of an entire rotation corresponding to $(\beta-\alpha)/360°$ when $\alpha<\beta<360°-\alpha$.

Figure 10:
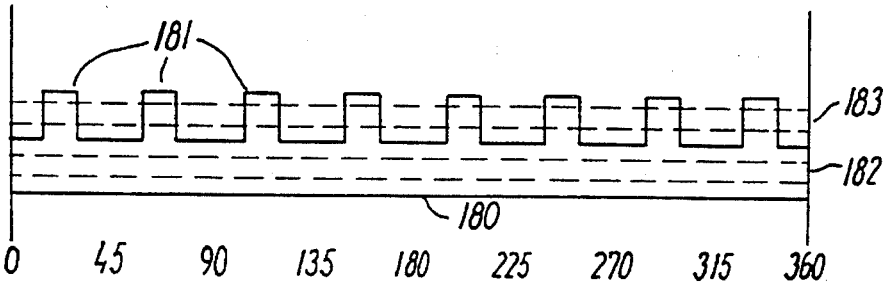
FIG. 10 illustrates an alternative embodiment of a path on a rotating member corresponding to the one of FIG. 9.

If it is desired to use the rotating member shown in FIG. 9 for generating a pulsating signal, e.g. for driving a rapidly flashing light diode, the rotating member would probably have to rotate inexpediently quickly because of the angular restrictions shown in FIG. 8. Instead, a path 160 (FIG. 9) Can be replaced by a path 180 which is shown in FIG. 10. The path 180 is conductive along the entire circumference of the rotating body 140, and it has a plurality of protruding branches 181. The two collector shoes are then displaced mutually in the axial direction of the rotatable body, so that one collector shoe, e.g. the one to which an input voltage is applied, sweeps over part of the path corresponding to the one marked in dashed lines 182. The other collector shoe, which is connected to the output terminal in this case, is caused to sweep over the part of the path marked in dashed lines 183. Thus, voltage will be applied to the conducting path part 180, 181 all the time, while the collector show on the output side will be in contact with the conducting path only when it passes the protruding branches 181.

If the switch is used in a commutator function, a damper may be incorporated to dampen electric noise, as will be well-known to a skilled person.

It is clear that the rotating member is not necessarily shaped as a drum, but may assume other forms suitable for the purpose. For example, the rotating member shown in FIG. 2 may be disc-shaped, and the partly conductive paths may be arranged to extend around the circular end faces of the member. The member may also be pulley-shaped with end flanges, with the actuation means located between the flanges.

Alternatively, projections may be provided on the end faces of the rotating member, and these projections, like the projections shown in FIGS. 1–4, break and make the electric connections of the stationary member.

We claim:

1. An electric switch comprising:

a housing containing a plurality of electric switch elements;

a substantially cylindrical member mounted for rotation within said housing, said cylindrical member including actuating means for opening and closing the switch elements upon rotation of the cylindrical member;

an axial through passage extending through said cylindrical member for receiving a drive shaft, whereby rotation of said drive shaft causes said cylindrical member to rotate;

a coupling bushing extending radially within said cylindrical member for detachably receiving an end of a lever;

a slot within said housing aligned with said bushing and through which said lever extends, when said lever is attached to said bushing, whereby movement of said lever is constrained to thereby limit rotation of said cylindrical member through a plurality of angular positions.

2. A switch according to claim 1, characterized in that both the axial passage (20) and the radial bushing (18) have cruciform cross-sections.

3. A switch according to claim 1, characterized in that the housing (12, 13) has said slot (22) extending along part of the circumference of the rotating member (16), and that the lever (19) extends through said slot (22) and is movable within the extent of said slot.

4. A switch according to claim 1, characterized in that terminal parts (**26*b*–29*b*; 152–155) on the switching elements (26–29) of the housing (12, 13) are in the form of mutually overlapping, but spaced leaf springs, which, when the rotating member (16) is rotated, are pressed against each other by radially protruding bosses (23, 24) provided on said rotating member (16), such that said bosses (23, 24) establish electric connection between the terminal parts (26*b*–29*b*; 152–155**).

5. A switch according to claim 1, characterized in that terminal parts on the switching elements of the housing (12, 13) have collector shoes (151–155) which are in sliding contact with the rotating member (150) along annular paths (**160*a*–160N) thereon, and that the electric connection is established in that said paths (160*a*–160N) on part (161*a*–161N) of their circumferential direction are coated with conductive material which interconnects the terminal parts during rotation of the rotatable member (150**).

6. A switch according to claim 1, wherein the contact pattern (FIG. 11) of the switching elements contacts, upon rotation of the rotatable member, runs through a sequence consisting of a plurality of subsequences (ABCBA) which are symmetrical, said contact pattern being the same in clockwise as well as counterclockwise rotation, characterized in that the protruding lever (19) can be mounted in a number of positions in the coupling bushing (18) of the rotating member corresponding to twice the number of subsequences, and that the extent of the slot (22) is such that half a subsequence (ABC/CBA) is run through upon movement of the lever (19) between two extreme positions.

7. An electric switch comprising a stationary member (12, 13) and a member (16) rotatable with respect to said stationary member, said stationary member (12, 13) having a plurality of electric switch elements (26–29) which are broken and connected upon rotation of the rotatable member (16), said rotatable member (16) having coupling means (18) for detachable mounting of a protruding lever (19), characterized in that, when the rotatable member rotates in one direction, the contact pattern (FIG. 11) runs through a sequence consisting of a plurality of subsequences (ABCBA) which are symmetrical, said contact pattern in the run-through of a subsequence being the same in clockwise as well as counterclockwise rotation, that the protruding lever (19) can be mounted in a number of positions corresponding to twice the number of subsequences (ABCBA), that the stationary member (12, 13) has a recess (22) extending along part of the circumference of the rotating member (16), said lever (19) being movable within the extent of the recess (22), and that the extent of the recess (22) is such that half a subsequence (ABC/CBA) is run through upon movement of the lever (19) between two extreme positions.

8. A switch according to claim 6, characterized in that the contact pattern (FIG. 11) runs through a sequence consisting of two identical subsequences (ABCBA), and that the slot or the recess (22) on the stationary member (12, 13) extends along one quarter of the circumference of the rotatable member (16).

9. A switch according to claim 7, characterized in that the contact pattern (FIG. 11) runs through a sequence consisting of two identical subsequences (ABCBA), and that the slot or the recess (22) on the housing (12, 13) extends along one quarter of the circumference of the rotatable member (16).

* * * * *